US005686820A

United States Patent [19]

Riggio, Jr.

[11] Patent Number: 5,686,820

[45] Date of Patent: Nov. 11, 1997

[54] VOLTAGE REGULATOR WITH A MINIMAL INPUT VOLTAGE REQUIREMENT

[75] Inventor: Salvatore Richard Riggio, Jr., Boca Raton, Fla.

[73] Assignee: International Business Machines Corporation, Armonk, N.Y.

[21] Appl. No.: 491,021

[22] Filed: Jun. 15, 1995

[51] Int. Cl.[6] ..... G05F 1/56

[52] U.S. Cl. ..... 323/273; 323/280

[58] Field of Search ..... 323/265, 273, 323/279, 280, 281, 282, 349, 351

[56] References Cited

U.S. PATENT DOCUMENTS

| | | | |
|---|---|---|---|
| 3,855,511 | 12/1974 | Smith | 318/317 |
| 4,110,677 | 8/1978 | Boronkay et al. | 323/280 |
| 4,264,785 | 4/1941 | Jacobson | 179/6.03 |
| 4,543,522 | 9/1985 | Moreau | 323/303 |
| 4,613,809 | 9/1986 | Skovmand | 323/268 |
| 4,779,037 | 10/1988 | Locascio | 323/275 |
| 4,808,907 | 2/1989 | Main | 323/316 |
| 4,983,903 | 1/1991 | Sano et al. | 323/274 |
| 5,087,891 | 2/1992 | Cytera | 330/288 |
| 5,097,198 | 3/1992 | Holmdahl | 323/280 |
| 5,103,157 | 4/1992 | Wright | 323/275 |
| 5,130,635 | 7/1992 | Kase | 323/280 |
| 5,182,526 | 1/1993 | Nelson | 330/257 |
| 5,225,766 | 6/1993 | O'Neill | 323/280 |
| 5,274,323 | 12/1993 | Dobkin et al. | 323/280 |
| 5,291,123 | 3/1994 | Brown | 323/689 |
| 5,344,928 | 8/1994 | Dobkin et al. | 323/280 |
| 5,384,530 | 1/1995 | Pfueger | 323/313 |

OTHER PUBLICATIONS

Charles L. Phillips and Royce D. Harbor, *Feedback Control Systems, Second Edition*, Prentice–Hall, Englewood Cliffs, N.J., 1991, pp. 15–30.

*Primary Examiner*—Adolf Berhane

*Attorney, Agent, or Firm*—Richard A. Tomlin; Ronald V. Davidge

[57] ABSTRACT

A voltage regulator, providing a constant-voltage output through an output terminal, includes an operational amplifier and an output stage driven by an output of the amplifier. A voltage reference is applied to a negative input terminal of the amplifier, and an input voltage, which is greater in magnitude than the output voltage, is applied to the output stage. A first feedback loop returns a signal proportional to the output voltage to the positive input of the amplifier. A second feedback loop extends between the output and input of the amplifier, including resistive and capacitative elements to stabilize the voltage regulator. In a version producing a positive output, the voltage reference applies a positive voltage to the amplifier, and the output stage includes a p-channel power MOSFET device. In a version producing a negative output, the voltage reference applies a negative voltage to the amplifier, and the output stage includes an n-channel power MOSFET device. While the input voltage must be greater than the output voltage, the difference between these voltages is minimized with this configuration, improving the efficiency of the voltage regulator.

16 Claims, 4 Drawing Sheets

VOLTAGE REGULATOR WITH A MINIMAL INPUT VOLTAGE REQUIREMENT

BACKGROUND OF THE INVENTION

1. Field of the Invention

This invention relates to voltage regulator circuits, and, more particularly, to a voltage regulator using a feedback amplifier within another feedback circuit to form a linear voltage regulator operating with a minimum input voltage level.

2. Background Information

A voltage regulator is a circuit providing a constant-level voltage output despite variations, within an operating range, in an input voltage level. Conventional voltage regulators are usually designed as switching voltage regulators, because such devices are typically far more efficient than linear voltage regulators. However, a switching voltage regulator, unlike a feedback voltage regulator, produce significant switching noise at its output. This noise often creates operating problems at the load being powered by the regulator. In situations where such noise is intolerable, a feedback voltage regulator is typically used despite its low efficiency and high heat loss. For low power applications, such as from five to fifty watts, feedback voltage regulators are widely used.

Conventional feedback voltage regulators include an output stage consisting of a single bipolar junction transistor, or of a cascaded pair of bipolar junction transistors called a "Darlington pair." To insure proper linear regulation of the output voltage, these devices must be kept out of saturation. To obtain this condition with a single output device, the input voltage must be one volt greater than the output voltage; with the cascaded pair, the input voltage must be two volts greater than the output voltage. This difference in voltage is the major cause of inefficiency in a conventional voltage regulator, resulting, for example, in a need for a large heat sink and a cooling fan.

What is needed is a high-efficiency voltage regulator retaining the low-noise advantages of a feedback regulator.

3. Description of the Prior Art

U.S. Pat. No. 4,613,809 to Scovman describes a feedback voltage regulator implemented in an integrated circuit, in which the need for a low dropout voltage, i.e. a low level of the minimum input voltage required to maintain regulation of the device at a predetermined output voltage, is addressed by using a PNP lateral pass transistor driven from a dual collector PNP, which in turn is driven from a operational amplifier having one input at a reference voltage and the other input operated from a voltage divider connected to the regulator output. While this device uses a minimum level of quiescent current, its input voltage must still be high enough to allow the use of bipolar junction transistors.

U.S. Pat. No. 4,983,905 to Sano et al. describes a feedback voltage regulator provided with an output transistor, for outputting a predetermined output voltage in accordance with an input voltage, and a operational amplifier. The circuit further comprises a reference voltage control means which monitors variations on the input voltage, providing the output of a predetermined constant voltage to the operational amplifier as a reference when the input voltage is higher than a predetermined voltage level. When the input voltage falls below the predetermined level, the voltage provided as an output from the reference voltage control means is varied in accordance with variation of the input voltage. Despite sophisticated control of the reference voltage, each device of Sano et al. includes, as an output stage, a conventional bipolar junction transistor or a pair of such transistors. Since the use of such a device or devices requires a relatively large difference between the input and output voltage levels, what is still needed is a way of providing the advantages of a feedback voltage regulator while obtaining a high level of efficiency.

U.S. Pat. Nos. 5,087,891 to Cytera and 5,291,123 show various constant current regulators using one or more FET devices in an output stage. However, these patents do not describe a way to use such transistors in a voltage regulator.

SUMMARY OF THE INVENTION

In accordance with one aspect of the invention, there is provided a voltage regulator for providing a constant voltage at an output terminal. The voltage regulator includes an input stage, an output stage, an input voltage applied to the output stage, and first and second feedback loops. The input stage includes an operational amplifier having a positive amplifier input, a negative amplifier input, and an amplifier output having an amplifier output signal proportional to a difference between signals applied to the positive and negative amplifier inputs. The output stage, which is driven by the amplifier output signal, provides an output voltage at the output terminal. The first feedback loop, which extends through the input and output stages, includes a first feedback portion extending from an output of the output stage to the positive amplifier input. The second feedback loop, which extends through the input stage, includes a second feedback portion extending from an output of said input stage to the negative amplifier input.

DETAILED DESCRIPTION

Figure 1:
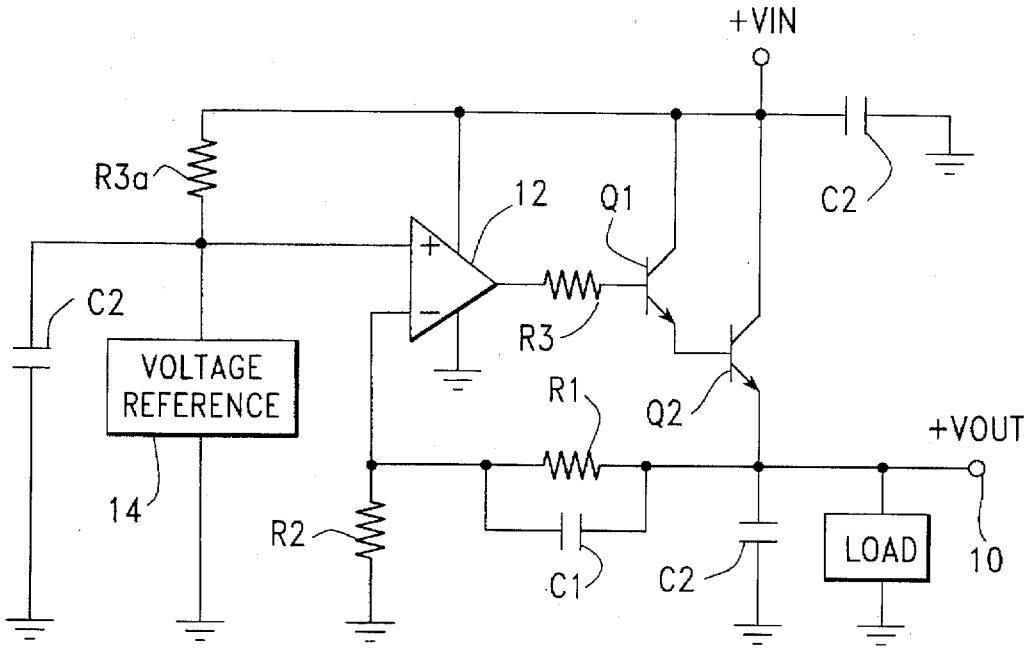
FIG. 1. PRIOR ART
FIG. 1 is a schematic view of a conventional feedback voltage regulator.

FIG. 1 is a schematic view of a conventional feedback voltage regulator. In this configuration, bipolar transistors Q1 and Q2 are used to supply the required output current at output node 10 under control of a operational amplifier 12. The regulated output voltage VOUT at output terminal 10 is connected to the negative input of an operational amplifier 12 through a resistor R1 and a capacitor C1, forming a conventional negative-feedback circuit. A voltage reference 14 provides a positive voltage to the positive input of operational amplifier 12. Resistor R1 acts with a resistor R2 to form a voltage divider, setting the gain through the feedback loop. A resistor R3 limits current when the voltage regulator is turned on. A resistor R3*a* determines the current flowing through voltage reference 12. Capacitors C2 perform decoupling functions, limiting the noise on various circuits.

This conventional voltage regulator suffers from an efficiency limitation due to the high minimum level of unregulated DC input voltage VIN needed at input terminal 14 to maintain proper operation. Under minimum voltage conditions, this voltage VIN must be at least three volts above the required output voltage VOUT, so that the amplifier 12 and transistors Q1 and Q2 can be biased into their active regions of operation. This requirement causes a great power loss under normal operating conditions. Since the requirement is placed on the minimum level of VIN, the rate at which power is lost is increased with increases in the actual level of VIN.

In this type of regulator, replacing bipolar transistors Q1 and Q2 with a power MOSFET worsens the situation, since the active region gate-to-source voltage of a power MOSFET is greater, about four to five volts, than the two base-to-emitter voltage drops required by transistors Q1 and Q2.

Figure 2:
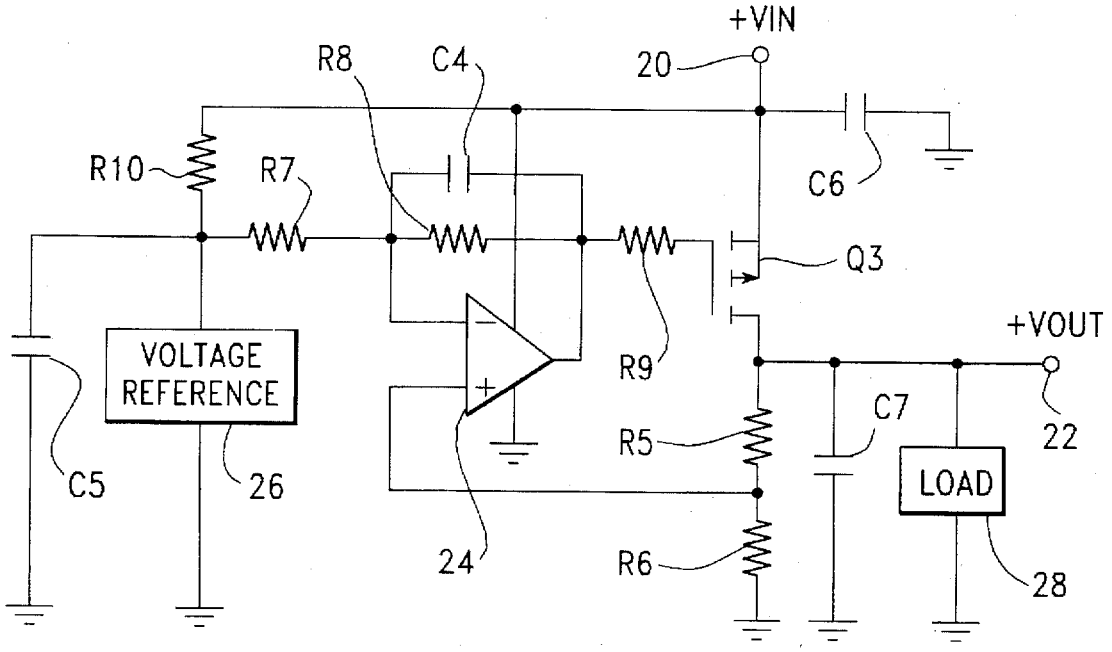
FIG. 2 is a schematic view of a voltage regulator built in accordance with a first embodiment of the present invention to produce a positive output voltage level.

FIG. 2 is a schematic view of a voltage regulator built in accordance with a first embodiment of the present invention. An unregulated input voltage VIN is provided to the regulator at a input terminal 20, while a regulated voltage VOUT is supplied by the regulator at the output terminal 22. In this regulator, the bipolar transistors Q1 and Q2 of the regulator described in reference to FIG. 1 are replaced by power MOSFET device Q3. Furthermore, in the circuit of FIG. 2, feedback of the output voltage VOUT, as divided through voltage dividing resistors R5 and R6, which are used to set the value of the output voltage VOUT, is connected to the positive terminal of the operational amplifier 24. There is also a second feedback loop, including voltage dividing resistors R7 and R8, which are used to set the gain of a first stage, and a compensating capacitor C4. This feedback loop, which is connected to the negative input of amplifier 24, is used to stabilize the amplifier 24 and to fix its DC voltage gain to a constant value.

Other components included within the voltage regulator of FIG. 2 are a decoupling capacitor C5, which is used to minimize noise on the voltage reference 26 and a second decoupling capacitor C6, which is used to minimize noise on the input terminal 20. A load capacitor C7 may be included as a part of the voltage regulator, or it may simply be a part of the load 28 itself, depending on the impedance characteristics of the load 28. A resistor R9 in series with the gate of FET device Q3 limits the current flowing into this gate when the voltage regulator is turned on. A resistor R10 sets the current flowing through the voltage reference 26.

The operational amplifier 24 is of a conventional type, producing an output which is proportional to a difference between an input at its positive (+) terminal and an input at its negative (−) terminal. Since the regulated output voltage VOUT is connected to the positive input terminal of the amplifier 24, creating positive feedback with zero degrees of phase shift, it is necessary to provide a power output stage that produces 180 degrees of phase shift to insure the stability of the DC loop. In the circuit of FIG. 2, this requirement is met through the use of P-channel power MOSFET device Q3. The input voltage VIN is applied to the source of FET device Q3, the output terminal 22 is connected to the drain of Q3, and the gate of Q3 is connected to the output of amplifier 24 through a resistor R9.

A significant improvement in efficiency, compared to the voltage regulator circuit of FIG. 1, is thus achieved. With the output signal of amplifier 24 applied through a resistor R7 to the gate of MOSFET device Q3, and with the regulated output voltage VOUT derived from the drain of MOSFET device Q3 the required output voltage is produced from a relatively low input voltage VIN. This occurs because the output of amplifier 24 increases to the magnitude of the gate-to-source voltage required by MOSFET device Q3 by moving toward ground, instead of by moving toward the input voltage VIN like the amplifier 22 of the circuit of FIG. 1.

The various characteristics of the circuit of FIG. 2 is most readily understood by considering its operation under AC (alternating current) and DC (direct current) conditions. The operation of the circuit under AC conditions, with a varying frequency, will first be considered, to determine particularly the conditions under which the circuit is stable. Next, the operation of the circuit under DC conditions will be considered, to determine particularly the conditions which must be met to achieve a desired output voltage. The various equations discussed below can be derived using Mason's Gain Formula, which is discussed in *Feedback Control Systems,* Second Edition, by Charles, L. Phillips and Royce D. Harbor, published by Prentice Hall in 1991, pages 26–30.

Figure 3:
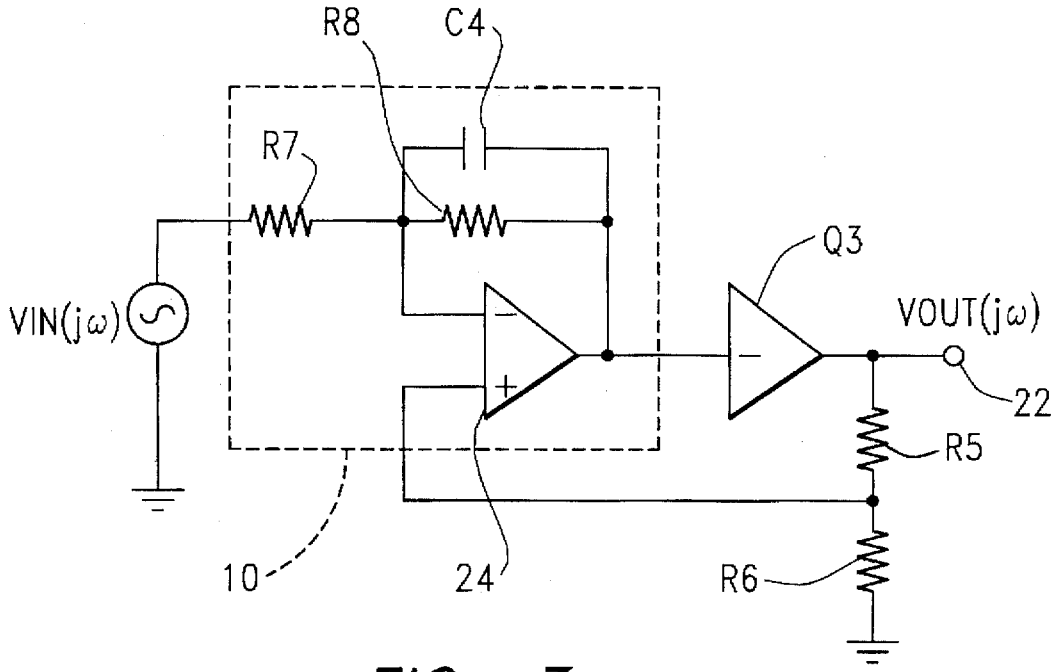
FIG. 3 is a simplified schematic view of the circuit of FIG. 2, showing the circuit elements affecting AC operation of the circuit.

FIG. 3 is a simplified schematic diagram of the circuit of FIG. 2, showing particularly the circuit elements affecting operation under AC conditions. For this type of analysis capacitors are generally considered to be short circuits. The exception to this is the compensating capacitor C4, which has a value in a range allowing operation as a capacitor with the frequencies being studied, providing phase compensation to prevent oscillation. For purposes of analysis, the amplifier 24 is grouped with resistors R7 and R8 and with capacitor C4 to form a first stage 30. For this analysis, the reference voltage 26 has been replaced by a variable-frequency AC source, indicated as VIN(jω).

Referring to FIGS. 2 and 3, the equations to be developed are functions of various circuit values, such as:

$A_0$=DC gain of amplifier 24

$A_1(j\omega)$=gain of first stage 30

$A_2$=DC gain of FET transistor Q3

$R_7$=resistance of resistor R7, etc.

The feedback factor of the first stage is given by:

$$\beta_1(j\omega)=\frac{R_7+j\omega C_4R_7R_8}{R_7+R_8+j\omega C_4R_7R_B} \quad 1)$$

The overall feedback factor is given by:

$$\beta_F=\frac{R_6}{R_5+R_6} \quad 2)$$

The gain with feedback of first stage 30 is given by:

$$A_1(j\omega)=\frac{A_0}{1+A_0\beta_1(j\omega)} \quad 3)$$

For the entire voltage regulator, the gain, which determines the ratio of the output and input voltages, is given by:

$$A_F(j\omega)=\frac{V_{OUT}(j\omega)}{V_{IN}(j\omega)}=\frac{A_1(j\omega)A_2}{1+A_1(j\omega)A_2B_F} \quad 4)$$

For the entire voltage regulator, the phase angle with feedback is given by:

$$\theta(j\omega)= \quad 5)$$

$$\arctan\left[\frac{\omega C_4R_7R_8}{R_7+R_8}\right]-\arctan\left[\frac{\omega C_4R_7R_8(1+A_0A_2\beta_F+A_0)}{(1+A_0A_2\beta_F)(R_7+R_6)+A_0R_7}\right]$$

Figure 4:
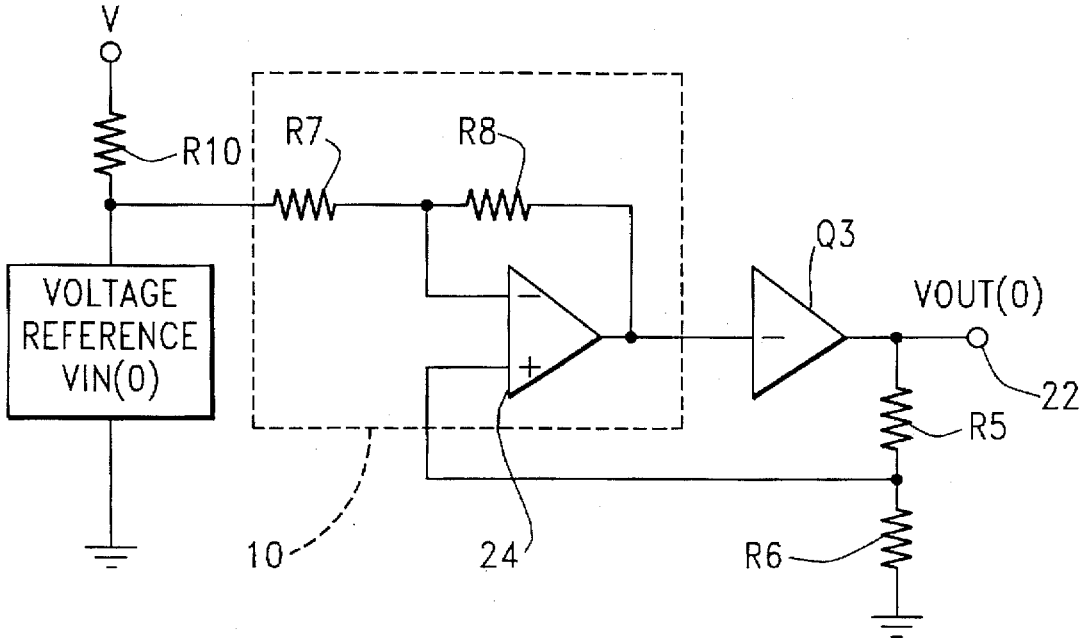
FIG. 4 is a simplified schematic view of the circuit of FIG. 2, showing the circuit elements affecting DC operation of the circuit.

FIG. 4 is a simplified schematic diagram of the circuit of FIG. 2, showing particularly the circuit elements affecting operation under DC conditions. For this analysis, capacitors car considered to be open circuits. In the following analysis, the various gains determined above are evaluated for the DC case, where:

$$\omega=0 \quad 6)$$

Under this condition, the feedback factor for the first stage is given by:

$$\beta_1(0)=\frac{R_7}{R_7+R_8} \quad 7)$$

Since only resistance values occur in the expression for the feedback factor for the second stage, this factor is the same for DC as for AC, being given by Equation 2).

The gain with feedback of first stage 30 is given by:

$$A_1(0)=\frac{A_0}{1+\frac{A_0R_7}{R_7+R_8}}=\frac{R_7+R_8}{\frac{R_7+R_8}{A_0}+R_7} \quad 8)$$

The gain with feedback of the entire device is given by:

$$A_F(0)=\frac{V_{OUT}(0)}{V_{IN}(0)}=\frac{1}{\frac{\frac{R_7+R_8}{A_0}+R_7}{(R_7+R_8)R_2}+\beta_F} \quad 10)$$

A particular example of a voltage regulator built in accordance with the present invention will now be examined for operation under AC and DC conditions. In this example, the following relationships are valid:

$$R_2 >> \frac{R_7+R_8}{A_0}$$

$$R_2 << A_2(R_7+R_8)$$

Therefore the equation given above for gain with feedback of the entire device can be simplified to:

$$A_F(0)\cong\frac{1}{\beta_F}=\frac{R_5+R_6}{R_6}=1+\frac{R_5}{R_6} \quad 11)$$

While the above equations, particularly equations 4) and 5) are useful in predicting the performance and stability of a voltage regulator built in accordance with the present invention, further examination of circuit parameters may be necessary to predict performance accurately. Typically, the largest sources of deviation from the performance predicted by these equations are the internal capacitance values of the FET device Q3. While these equations do not predict changes in gain and phase through the circuit with increases in the load current flowing through load 28, such changes occur in a practical circuit, with the effective level of the open-circuit gain and phase of the FET device varying with loading.

To aid in the understanding of this type of voltage regulator, an example of this circuit has been simulated, built and tested using the following component values:

$R_5=R_6=2K$
$R_7=1K$
$R_8=100K$
$R_9=30\ \Omega$
$R_{10}=10K$
$C_4=0.1\ \mu f$
$C_5=10\ \mu f$
$C_6=C_7=1\ f$ In this exemplary circuit, a National Semiconductor, part number LM358, was used for operational amplifier 24, and FET device Q3 was an International Rectifier MOSFET, part number IRF9530. These devices provide the following minimum values:

$A_0=10{,}000$
$A_2=10$

Figure 5:
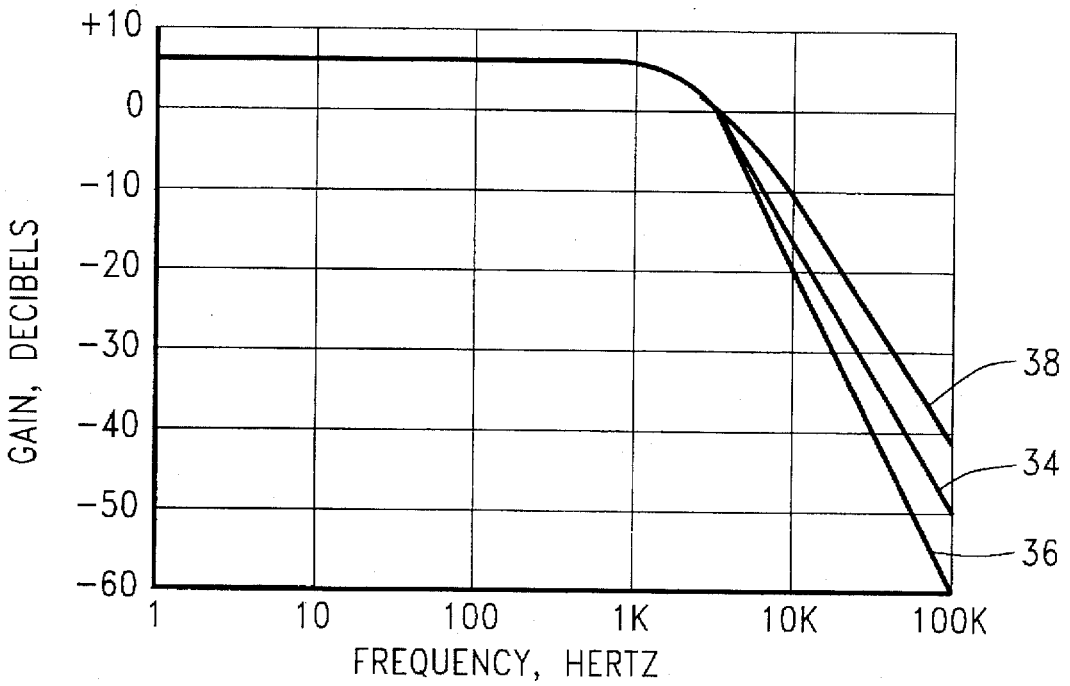
FIG. 5 is a graphical view of variations in the AC gain occurring with variations in input frequency and output current of an exemplary version of the circuit of FIG. 2.

FIG. 5 is a graph showing variations in the AC gain occurring with variations in the input frequency of VIN(jω) and of the load current through load 28 (shown in FIG. 2), of the exemplary circuit. A first curve 34 indicates the AC gain predicted by Equation 4). Since the resistance values of resistors R5 and R6 are equal, it is evident from Equation 11) that the DC gain of the this circuit is 2.0. This fact is shown in curve 34 by the fact that the gain of the device is +6.0 dB, corresponding to a ratio of 2:1, at low levels of frequency. As the input frequency is increased above about 1K Hz, the ability of the circuit to follow the input signal decreases, with the circuit exhibiting a gain of about −50 dB at 100K Hz. The results of simulation and of operation of the exemplary circuit are shown by a second curve 36, which indicates operation at a load current of 0.5 amp, and by a third curve 38, which indicates operation at a load current of 5.0 amp. The simulation process, which confirmed measurements made using the exemplary circuit, included the consideration of effects caused, for example, by internal capacitance values of the FET device Q3.

Figure 6:
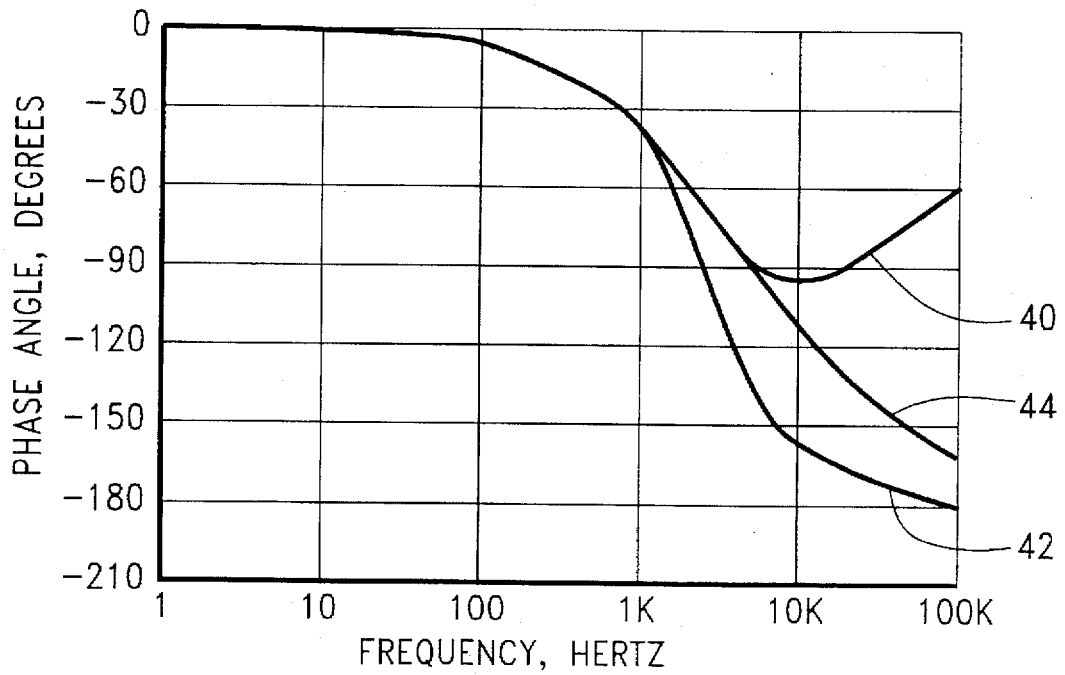
FIG. 6 is a graphical view of variations in the phase angle between input and output signals of the exemplary circuit for which data is shown in FIG. 5.

FIG. 6 is a graph showing variations in the phase angle between input and output signals, again with variations in the input frequency and output load. A first curve 40 indicates the phase angle θ(jω) predicted by Equation 5). A second curve 42 shows the variation of the phase angle as the circuit is operated with a load current of 0.5 amp, and a third curve 44 shows the effects of operation at a load current of 5.0 amp.

The stability of operation of the exemplary circuit can be determined by comparing FIGS. 5 and 6. With a positive feedback system, such as a voltage regulator built in accordance with the present invention, instability occurs if the phase angle difference reaches 180 degrees with a gain greater than 0 dB. As shown in FIG. 5, the gain functions pass through 0 dB at about 2K Hz. As shown in FIG. 6, phase angle difference is between 75 and 120 degrees at this frequency, depending on the load current. This indicates a substantial safety margin from the critical value of 180 degrees.

Figure 7:
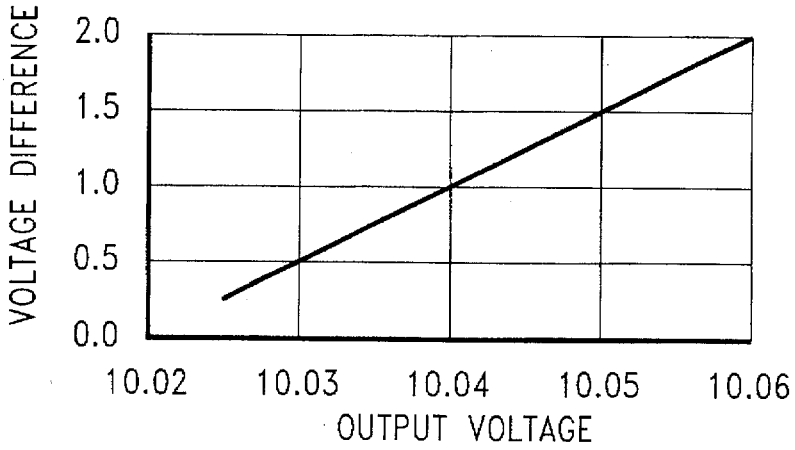
FIG. 7 is a graphical view of the minimum difference between input and output voltage levels of the exemplary circuit for which data is shown in FIG. 5.

FIG. 7 is a graph showing the minimum allowable difference between VIN and VOUT (both shown in FIG. 2) in the exemplary circuit, for an output voltage range near 10 volts. This difference is required to keep the input voltage VIN, above a level referred to as the "drop out voltage," above which the voltage regulator remains in regulation without creating an error condition. While the input voltage VIN must be greater than the output voltage VOUT, as described in reference to FIG. 2, this voltage difference is the principle cause of inefficiency in the voltage regulator circuit, and therefore of circuit heating. The input voltage VIN can be higher than the voltage determined using these differences, and is expected to be higher with variations in the unregulated supply providing VIN. In the example of FIG. 7, this voltage difference needs to be 0.1 to 2.0 volts, depending on the output voltage required. A circuit of this type can be optimized for the particular output voltage needed, with practical operation being established with a minimum voltage difference of 0.1 to 0.2 volts.

Figure 8:
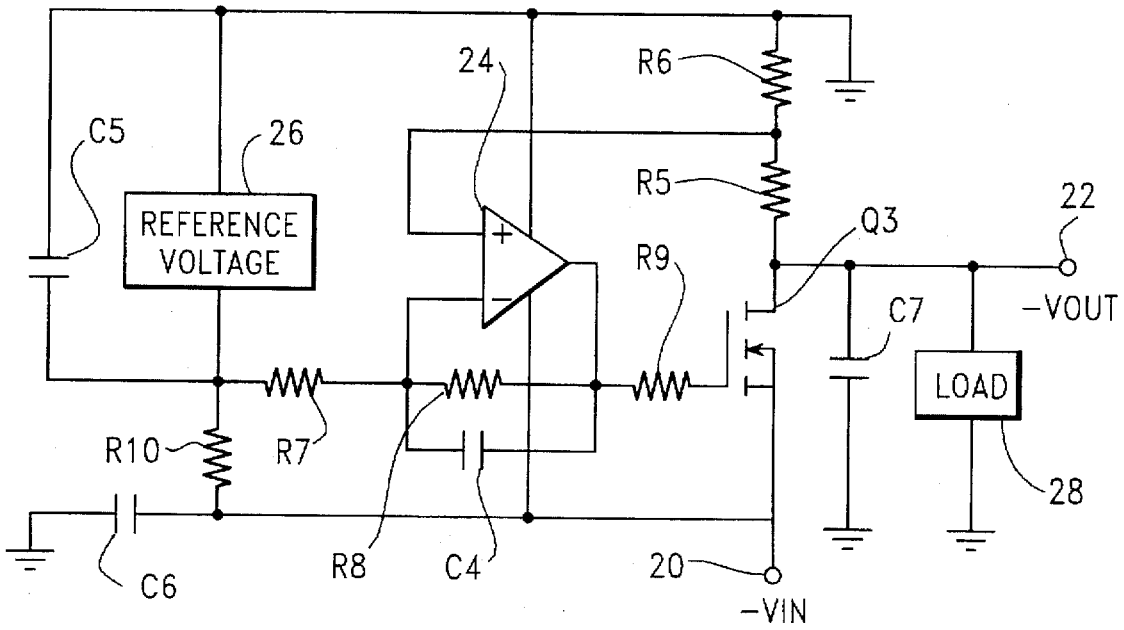
FIG. 8 is a schematic view of a voltage regulator built in accordance with a second embodiment of the present invention to produce a negative output voltage level.

FIG. 8 is a schematic diagram of a second version of a device built in accordance with the present invention. This version is configured to provide a regulated negative output voltage –VOUT. Since most of the components and operational characteristics of the circuit of FIG. 8 are similar or identical to corresponding components and operational characteristics of the circuit of FIG. 2, the following discussion is focussed on the differences between these circuits. Identical or similar elements are given like reference characters.

In the circuit of FIG. 8, the output stage includes an N-channel power MOSFET device Q4, instead of the P-channel device Q3 of the circuit of FIG. 2. The source of device Q4 is connected to output terminal 22 and to electrical ground through voltage dividing resistors R5 and R6. The drain of device Q4 is connected to a negative input voltage –VIN. The gate of device Q4 is again connected to the output of an operational amplifier 24 through a resistor R4, which limits the gate current through device Q4 when the voltage regulator is first turned on. As in the voltage regulator of FIG. 2, the node between resistors R5 and R6 is tied to the positive input of operational amplifier 24. As in the voltage regulator of FIG. 2, a feedback loop including a resistor R8 and a capacitor C4 extends between the output of operational amplifier 24 and its input. In the circuit of FIG. 8, the voltage reference 26 is arranged to apply a negative voltage to the negative input of operational amplifier 26 through a resistor R4.

With a device built in accordance with the present invention, significant advantages are gained over voltage regulators of the prior art and background art. The characteristics of the circuit allow the output stage to be an enhancement-mode P-channel or N-channel MOSFET device. Particular advantages of this circuit include a low "on-resistance" of the channel, and a wide source-to-gate voltage range provided by the output of the driving operational amplifier 24 (shown in FIG. 2), connected to the gate of the MOSFET device. Minimum output current occurs when the magnitude of the source-to-gate voltage is made slightly greater than the threshold voltage of the output device, while the maximum output current value is achieved when the magnitude of the source-to-gate voltage is made much greater than he threshold voltage of the output device. The gate of a P-channel MOSFET device can be at a much lower voltage than the voltage of the drain. Similarly, the gate of an N-channel MOSFET device can be at a much higher voltage than the drain of the device. The negative input voltage –VIN must be greater in absolute magnitude, i.e. more negative, than the negative output voltage –VOUT, and this difference, which again limits the efficiency of the voltage regulator, is minimized by the circuit configuration.

On the other hand, this type of flexibility is not available with the bipolar junction transistors used in the output stages of the background art and the prior art. A bipolar junction transistor limits the drop-out voltage to one volt, plus the output voltage for a single output device, or to as high as two volts, plus the output voltage value, in the case where two cascaded output devices are used, as shown in FIG. 1. This requirement is caused by a need to keep the bipolar junction transistors out of saturation in order to insure proper linear regulation of the output voltage.

Furthermore, a voltage regulator built in accordance with the present invention has an inherent form of short-circuit protection, which is not present in conventional voltage regulators having a final stage consisting of one or two bipolar junction transistors. In the present invention, the MOSFET device acts as a resistor naturally limiting the output current, so that, in the case of a short circuit within the load, the output voltage linearly decays in value.

A voltage regulator built in accordance with the present invention also has a much higher output current capability, and a wider output current range, than a conventional voltage regulator. These advantages are caused by the fact that the MOSFET device requires little or no input gate current to supply a high output current. The high value and wide range of output current are provided by the widely variable source-to-gate capability of the operational amplifier connected to the gate of the MOSFET device. That is, the MOSFET device is voltage-driven, rather than current-driven, like a bipolar junction transistor. On the other hand, bipolar junction transistors require a significant change in input current, with very little change in the input emitter-to-base voltage, to maintain a wide range of output current. Also, the MOSFET device can typically handle a higher output current, since it typically has a much larger die size and a lower thermal resistance factor than a bipolar junction transistor of comparable size.

When a filter capacitor is added to the output of a voltage regulator of the present invention, the noise filtering capability of the device is much improved over that of a device using a bipolar junction transistor, due to the resistive nature of the channel of the MOSFET device. Such a filter capacitor also improves the ability of the voltage regulator to supply current during dynamic load current changes.

While the invention has been described in its preferred form or embodiment with some degree of particularity, it is understood that this description has been given only by way of example and that numerous changes in the details of construction, fabrication and use, including the combination and arrangement of parts, may be made without departing from the spirit and scope of the invention.

What is claimed is:

1. A voltage regulator for providing a constant voltage at an output terminal, wherein said voltage regulator comprises:

an input stage including an operational amplifier having a positive amplifier input, a negative amplifier input, and an amplifier output having an amplifier output signal proportional to a difference between a first signal on said positive amplifier input and a second signal on said negative amplifier input;

an output stage, including a power transistor driven by said amplifier output signal, providing a voltage output at said output terminal;

a reference voltage applied to said negative amplifier input;

an input voltage applied to said output stage;

a first feedback loop extending through said input stage and said output stage, said first feedback loop including a first feedback portion extending from an output of said output stage to said positive amplifier input; and a second feedback loop extending through said input stage, said second feedback loop including a second feedback loop portion extending from an output of said input stage to said negative amplifier input.

2. The voltage regulator of claim 1, wherein said first feedback loop portion extends through a voltage dividing resistor network.

3. The voltage regulator of claim 2, wherein said second feedback loop includes resistive and capacitive elements.

4. The voltage regulator of claim 3, wherein said second feedback loop includes a resistor in parallel with a capacitor.

5. The voltage regulator of claim 1, wherein said power transistor is an FET device having a gate driven by said amplifier output signal.

6. The voltage regulator of claim 5, wherein said first feedback loop portion extends through a voltage dividing resistor network.

7. The voltage regulator of claim 6, wherein said second feedback loop includes resistive and capacitive elements.

8. The voltage regulator of claim 7, wherein said second feedback loop includes a resistor in parallel with a capacitor.

9. The voltage regulator of claim 1, wherein said input voltage is applied through a resistor to said reference voltage.

10. A voltage regulator for providing a constant voltage at an output terminal, wherein said voltage regulator comprises:

an input stage including an operational amplifier having a positive amplifier input, a negative amplifier input, and an amplifier output having an amplifier output signal proportional to a difference between a first signal on said positive amplifier input and a second signal on said negative amplifier input;

an output stage including a p-channel power MOSFET device, driven by said amplifier output signal, providing a voltage output at said output terminal, wherein a positive input voltage is applied to said output stage at a source of said power MOSFET device, wherein said output terminal is connected to a source of said power MOSFET device, and wherein a gate of said MOSFET device is driven by said amplifier output;

a reference voltage applying a positive voltage to said negative amplifier input;

a first feedback loop extending through said input stage and said output stage, said first feedback loop including a first feedback portion extending from an output of said output stage to said positive amplifier input; and a second feedback loop extending through said input stage, said second feedback loop including a second feedback loop portion extending from an output of said input stage to said negative amplifier input.

11. The voltage regulator of claim 10:

wherein said first feedback portion extends through a voltage divider network; and wherein said second feedback portion includes resistive and capacitive elements.

12. A voltage regulator for providing a constant voltage at an output terminal, wherein said voltage regulator comprises:

an input stage including an operational amplifier having a positive amplifier input, a negative amplifier input, and an amplifier output having an amplifier output signal proportional to a difference between a first signal on said positive amplifier input and a second signal on said negative amplifier input;

an output stage including an n-channel power MOSFET device, driven by said amplifier output signal, providing a voltage output at said output terminal, wherein a negative input voltage is applied to said output stage at a drain of said power MOSFET device, wherein said output terminal is connected to a source of said power MOSFET device, and wherein a gate of said MOSFET device is driven by said amplifier output;

a reference voltage applying a negative voltage to said negative amplifier input;

a first feedback loop extending through said input stage and said output stage, said first feedback loop including a first feedback portion extending from an output of said output stage to said positive amplifier input; and a second feedback loop extending through said input stage, said second feedback loop including a second feedback loop portion extending from an output of said input stage to said negative amplifier input.

13. The voltage regulator of claim 12:

wherein said first feedback portion extends through a voltage divider network; and wherein said second feedback portion includes resistive and capacitive elements.

14. A voltage regulator comprising:

a voltage reference;

an input amplifier having a positive amplifier input, a negative amplifier input to which said voltage reference is applied, and an amplifier output providing an amplifier output signal having a voltage level proportional to a voltage difference between said positive amplifier input and said negative amplifier input;

an output stage, including a power transistor, driven by said amplifier output signal;

an output terminal connected to an output of said power transistor in said output stage a first feedback loop applying a first feedback signal proportional to a voltage of said output terminal to said positive amplifier input; and a second feedback loop applying a second feedback signal to said negative amplifier input, wherein said second feedback signal is derived by passing said amplifier output signal through an impedance and wherein said second feedback signal stabilizes operation of said voltage regulator.

15. A voltage regulator comprising:

an input amplifier having a positive amplifier input, a negative amplifier input to which said voltage reference is applied, and an amplifier output providing an amplifier output signal having a voltage level proportional to a difference between said positive amplifier input and said negative amplifier input;

a voltage reference applying a positive voltage to said negative amplifier input;

an output stage driven by said amplifier output signal, wherein said output stage includes a p-channel power MOSFET device having a gate driven by said amplifier output signal, a source to which a positive input voltage is applied, and a drain to which said output terminal is connected;

an output terminal connected to said output stage;

a first feedback loop applying a first feedback signal proportional to a voltage of said output terminal to said positive amplifier input;

a second feedback loop applying a second feedback signal to said negative amplifier input, wherein said second feedback signal is derived by passing said amplifier output signal through an impedance and wherein said second feedback signal stabilizes operation of said voltage regulator.

16. A voltage regulator comprising:

an input amplifier having a positive amplifier input, a negative amplifier input to which said voltage reference is applied, and an amplifier output providing an amplifier output signal having a voltage level proportional to a difference between said positive amplifier input and said negative amplifier input;

a voltage reference applying a negative voltage to said negative amplifier input;

an output stage driven by said amplifier output signal, wherein said output stage includes an n-channel power MOSFET device having a gate driven by said amplifier output signal, a source to which a negative input voltage is applied, and a source to which said output terminal is connected;

an output terminal connected to said output stage;

a first feedback loop applying a first feedback signal proportional to a voltage of said output terminal to said positive amplifier input;

a second feedback loop applying a second feedback signal to said negative amplifier input, wherein said second feedback signal is derived by passing said amplifier output signal through an impedance and wherein said second feedback signal stabilizes operation of said voltage regulator.

* * * * *